United States Patent [19]

Chaudot

[11] Patent Number: 4,553,989

[45] Date of Patent: Nov. 19, 1985

[54] SAFETY SYSTEM FOR REMOVING ANY RISK OF CARRYING LIQUIDS TO THE NOSE OF THE FLARE OR TO THE VENT-HOLE DURING BURNING OR DISPERSION OF THE GASES ASSOCIATED WITH PRODUCTION

[76] Inventor: Gérard Chaudot, 14 Allée de la Rochefoucauld, Andresy 78570, France

[21] Appl. No.: 563,388

[22] PCT Filed: Mar. 11, 1983

[86] PCT No.: PCT/FR83/00050

§ 371 Date: Nov. 14, 1983

§ 102(e) Date: Nov. 14, 1983

[87] PCT Pub. No.: WO83/03280

PCT Pub. Date: Sep. 29, 1983

[30] Foreign Application Priority Data

Mar. 12, 1982 [FR] France ..... 82 04246

[51] Int. Cl.[4] ..... B01D 19/00

[52] U.S. Cl. ..... 55/177; 55/191; 55/204; 55/385 R; 55/459 R

[58] Field of Search ..... 55/176, 177, 191, 204, 55/205, 207, 385 R, 459 R, 460

[56] References Cited

U.S. PATENT DOCUMENTS

| | | | |
|---|---|---|---|
| 1,863,111 | 6/1932 | Greve | 55/207 |
| 2,578,568 | 12/1951 | Mayer et al. | 55/205 |
| 2,857,979 | 10/1958 | van Dijck | 55/459 R X |
| 3,088,595 | 5/1963 | Robb | 55/204 X |
| 3,151,961 | 10/1964 | Blackmore et al. | 55/205 |
| 3,362,140 | 1/1968 | Mott | 55/459 R X |
| 3,386,230 | 6/1968 | Riesberg et al. | 55/459 R X |
| 3,486,306 | 12/1969 | Blackmore et al. | 55/205 |
| 3,771,290 | 11/1973 | Stethem | 55/205 |
| 3,778,984 | 12/1973 | Lawser | 55/459 R X |
| 3,875,998 | 4/1975 | Charpentier | 166/0.5 |
| 4,113,450 | 9/1978 | Goransson et al. | 55/459 R X |

FOREIGN PATENT DOCUMENTS

| | | | |
|---|---|---|---|
| 856195 | 12/1960 | United Kingdom | 55/459 R |

*Primary Examiner*—Robert Spitzer

*Attorney, Agent, or Firm*—Scully, Scott, Murphy & Presser

[57] ABSTRACT

The invention provides a safety system comprising in the gas flow chain, between the liquid entrainment source and the nose of the flare or of the vent-hole, at least one capacity such as a flare foot tank (1) having at least one overflow column (4) opening below a liquid level (5,6), for example the sea, at a predetermined distance from its tapping (11) to said capacity. It further comprises means (7) for avoiding, should liquid overflow into the overflow column (4), the retention and entrapping of gases in the overflowed liquid or below said liquid.

17 Claims, 2 Drawing Figures

SAFETY SYSTEM FOR REMOVING ANY RISK OF CARRYING LIQUIDS TO THE NOSE OF THE FLARE OR TO THE VENT-HOLE DURING BURNING OR DISPERSION OF THE GASES ASSOCIATED WITH PRODUCTION

The present certificate of addition relates to improvements to the safety system forming the subject matter of tha parent patent application, United States patent application, Ser. No. 506,647, filed May 23, 1983, for a "System for Preventing Liquids from being Driven to the Flare Stack Tip", the entire application of which is hereby incorporated by reference, for removing any risk of carrying liquids to the flare nose or to the vent-hole during burning or dispersion of the gases associated with the production or treatment of hydrocarbons on land and at sea.

It is recalled that this system uses, in the gas flow chain, between the liquid entrainment source and the nose of the flare or torch or the vent-hole, at least one capacity such as a flare foot tank having an overflow column opening below a liquid level, for example the sea, at a given distance from its tapping on said capacity.

A first improvement to the invention aims at avoiding, should liquid overflow into the overflow column, retention and trapping of gas in the overflowed liquid, or therebelow, which would result in uncertain operation of the previously described safety system assembly.

This improvement consists then in providing a circuit such as a tube with strainer inside the overflow column or a duct external thereto, for the rising gases, for discharging, as far as the installations situated upstream of the overflow tube, the existing gases or the gases carried along by liquids in the oveflow column.

The invention also provides a second improvement for providing better operational safety of the overflow column, by detecting an abnormally high liquid level in said overflow tube.

In fact, during the life of the installation, the overflow tube may lose its safety quality by partial or total stopping thereof, either by subsequent re-dimensioning of the installations placed upstream, leading to liquid flows likely to overflow into the overflow column which are incompatible with the initial dimensioning thereof.

The second improvement to the safety system consists then, in accordance with the invention, in equipping the overflow column with one or more detection members for detecting the presence of hydrocarbons at an abnormal level. These detection members may consist of high level detectors placed in the aerial part of the overflow column, or one or more pressure detectors, differential or not, placed more generally in the low part of the overflow column. These detectors may also be designed so as to detect the presence of a hydrocarbons, for example by optical effect, capacitive effect, magnetic effect, electromagnetic effect or else by measuring vibratory phenomena.

All these detectors may be placed either in the overflow column, or outside and may be protected or not by associated piping.

Thus, whatever the mode of detection and the device or devices used, by detecting the presence of hydrocarbons at an abnormal level:

should the installation fall into disarrangement, warning may be given of its malfunction and the flow of fluids in the installation may possibly be stopped if the malfunction cannot be corrected automatically or not;

the service capacity of the safety device assembly may be periodically checked by appropriate means.

This checking may for example consist in injecting water at a known flowrate in all or part of the safety system assembly, the injction being effected at any point in the installation but so as to allow the operation of all or part of the safety system to be checked.

The invention also provides a third improvement for increasing the capacity of retaining overflowed liquids and finally for increasing the overall safety of the system, by multiplying the number of overflow columns so as to not to create either localized stresses which are too high considering the required retention capacity.

For this, a multiplicity of overflow tubes may be used, these being possibly set up in favorable zones, all or part of the existing underlying structures being for example possibly used for construction thereof.

Bringing these overflow columns into service may if necessary take place when the installation is first brought into service, or partially delayed in time depending on the required development of the capacity of the installation. Each of the overflow columns is equipped if required with the preceding improvements.

Embodiments of the invention will be described hereafter by way of non limiting examples, with reference to the accompanying drawings in which.

As previously mentioned, the safety system to which the improvements of the invention apply is intended for equipping hydrocarbon production installations on land and at sea.

These installations may comprise, as described in the parent patent application, a liquid hydrocarbon entrainment source formed by a separator receiving the crude oil or the gas through an inlet duct. This separator may be equipped, in a known way, with a circuit for normally taking up the oil or condensates and a gas outlet connected to a gas flow chain going as far as the flare nose.

This gas flow chain comprises, between the separator and the nose of the flare, a flare foot tank, or equivalent, equipped in a known way with a drip collection circuit possibly comprising a pump.

These installations may further comprise, in accordance with the parent patent application, an overflow column tapped on the flare foot tank at a location corresponding to a maximum predetermined level and opening below the level of the sea at a predetermined distance below the tapping on said tank.

Figure 1:
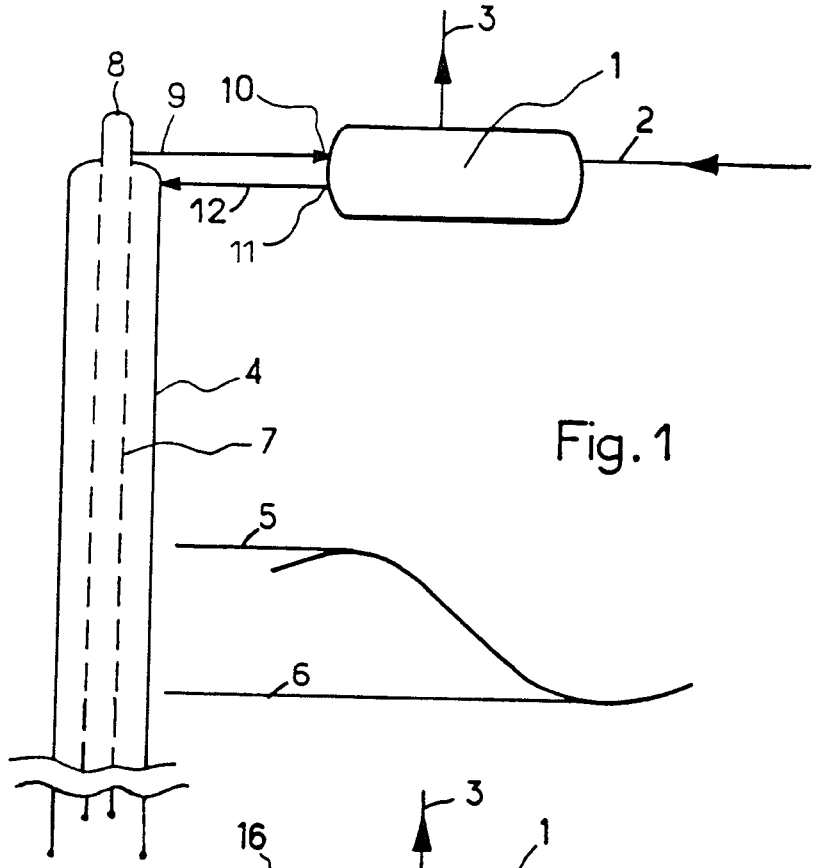
FIG. 1 is a schematical representation of a safety system in which the overflow tube is equipped with a strainer tube for removing the gases.
Figure 2:
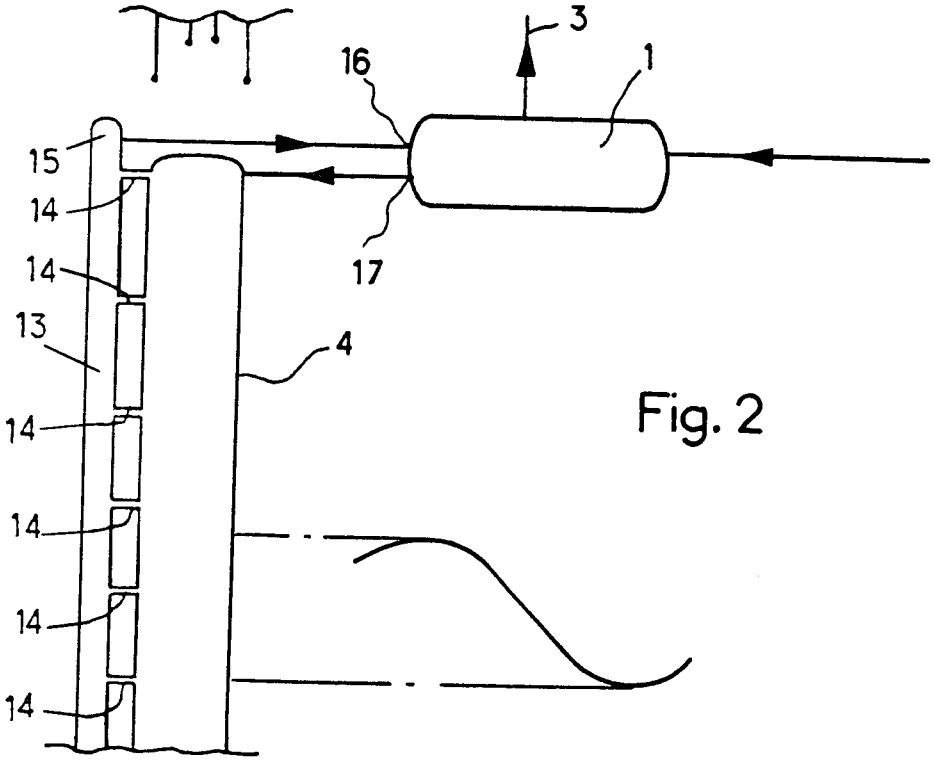
FIG. 2 is a schematical representation of a safety system in which the overflow tube is equipped with an external circuit for removing the gases.

However, for the sake of simplification and clarity, only a part of the installation has been shown in FIGS. 1 and 2 of the present certificate of addition comprising a flare foot tank 1 mounted at the end of the gas entrainment chain 2 and connected, at its upper part, to the flare shaft 3. On this flare foot tank 1 there is further tapped an overflow column 4 at a position corresponding to a maximum predetermined level, opening below the level 5,6 of the sea.

In the embodiment shown in FIG. 1, this overflow column 4 comprises, inside, a strainer tube 7 substantially coaxial and of smaller section than column 4.

The lower end of this strainer tube 7 is, at the lowest, in the vicinity of the lowest level 6 reached by the water inside the overflow column 4 during operation of the system.

It upper end 8 is connected (duct 9) either to the flare foot tank 1 at a point 10 situated above the tapping level of the overflow column 4 to said tank 1 (as in the example shown) or to the flare shaft if this latter plays the role of flare foot tank.

It should be stated that preferably the tapping point 10 for the strainer tube is situated at a point in the circuit for venting the gases to the atmosphere such that the separation of the liquids possibly carried along by the rising gases may take place before the gases are vented to the atmosphere.

Furthermore, the horizontal or sub-horizontal part 12 of the overflow column 4 may preferably, but not necessarily open tangentially into the vertical or sub-vertical part of the overflow column 4 so as to minimize entrapping or entrainment of gases in said column 4. For the same purpose, the inner surface of the upper end of the vertical part of the overflow column 4 may, preferably but not necessarily, be equipped with devices, for example with guide fins or helcial ramps generating a helical movement of liquids descending in the overflow column 4, so as to promote flow of the descending liquids and create a central chimney for removing the gases trapped below the liquids or carried along thereby. Depending on the geographical position of the installation in which the safety system will be installed, the direction in which the guide ramps for example are wound will depend on the Earth's hemisphere in which it is located (so as to take into account the Coriolis forces).

FIG. 2 relates to a second embodiment of a circuit for removing the gases inside the overflow column 4. This circuit which allows effects to be obtained similar to those obtained with the previously described strainer tube is however distinguished therefrom by the fact that it uses, for removing the gases trapped in the overflow column 4, a discharge tube 13 placed externally.

This discharge tube 13 (vertical) which is placed substantially parallel to the overflow column 4 communicates therewith through a series of pipes 14, possibly horizontal, for removing the gases trapped at different levels.

The upper end 15 of this discharge tube 13 is connected to the flare foot tank 1 at a point 16 situated above the tapping 17 of the overflow column 4 to said tank 1, it of course being understood that this connection could also be made to the flare shaft 3 in the case where this latter plays the role of flare foot tank.

I claim:

1. An improved safety system for preventing the accidental burning of liquids that might become entrained in a hydrocarbon gas stream during burning or dispersion of gases associated with the production or treatment of hydrocarbons, this system comprising, in a gas flow chain, between a liquid entrainment source and a nose of a flare tip, at least one tank (1) having at least one overflow column (4) opening below a liquid level (5,6), at a predetermined distance from a tapping point (11) to said tank, the improvement comprising: means (7,13,14) for avoiding, in the case of liquid overflowing into the overflow column (4), the retention and trapping of gases in the overflow column (4), the retention and trapping of gases in the overflow liquid.

2. The system according to claim 1, characterized in that it comprises a circuit (9) for removing, as far as the installation situated upstream of the overflow column (4), existing gases or gases entrained by liquids in said overflow column (4).

3. The system according to claim 2, characterized in that said gas removal circuit consists of a strainer tube (7) having an upper and lower end and a smaller cross section than the overflow column (4) and mounted thereinside.

4. The system according to claim 3, characterized in that the lower end of the strainer tube 7 is placed, at the lowest, in the vicinity of the lowest level (6) reached by the water in the overflow column (4).

5. The system according to claim 3, characterized in that the upper end (8) of the strainer tube 7 is connected to the tank (1) at a tapping point (10) situated above the tapping (11) of the overflow column (4) to said tank (1).

6. The system according to claim 5, characterized in that the tapping point (10) of said strainer tube (7) to the installation is located at a point where the gases are vented to the atmosphere so that the separation of the liquids, carried along by the rising gases, may take place before venting of the gases to the atmosphere.

7. The system according to claim 3 characterized in that the upper end (8) of the strainer tube (7) is connected to a flare shaft (3) connected to the upper end of the tank (1) in the case where said flare shaft (3) plays the role of the tank (1).

8. The system according to claims 1 or 2, characterized in that a substantially horizontal part (12) of the overflow column (4) opens tangentially into said overflow column (4) so as to minimize trapping or entrainment of gases in said column (4).

9. The system according to claims 1 or 2, characterized in that the inner surface of the upper end of the overflow column (4) is equipped with guide members for generating a helical movement of liquids descending in the overflow column, so as to promote flow of the descending liquids and create a central chimney for removing gases trapped below the liquids or carried along thereby.

10. The system according to claims 1 or 2, characterized in that said gas removal circuit comprises a gas discharge tube (13) placed outside the overflow column (4) and communicating with said overflow column through a series of pipes (14) situated at different levels.

11. The system according to claim 10, characterized in that the upper end (15) of said discharge tube (13) is connected to the tank (1) at a point (16) situated above the tapping point (17) of the overflow column (4) to said tank (1).

12. The system according to claim 10, characterized in that the upper end (15) of said discharge tube (13) is connected to a flare shaft (3) connected to the upper end of the tank (1) if said flare shaft (3) plays the role of the tank (1).

13. The system according to claim 1, characterized in that the overflow column (4) is equipped with at least one detection member for detecting the presence of hydrocarbons at an abnormal level inside said overflow column (4).

14. The system according to claim 13, characterized in that said detection member consists of one or more high level detectors placed in the aerial part of the overflow column (4), said detectors designed so as to detect the presence of hydrocarbons.

15. The system according to one of claims 13 or 14, characterized in that said detection member is placed outside the overflow column (4) and is protected by an associated pipe.

16. The system according to claim 13, characterized in that said detection members consist of one or more pressure detectors placed in the lower end of the overflow column (4), said detectors designed to detect the presence of hydrocarbons.

17. The system according to claims 1 or 2, characterized in that said system uses a multiplicity of overflow columns (4) set up in the most favorable zones of the gas flow chain.

* * * * *